US009827458B2

(12) United States Patent
Dalton

(10) Patent No.: US 9,827,458 B2
(45) Date of Patent: Nov. 28, 2017

(54) RECUMBENT STEP EXERCISER WITH SELF-CENTERING MECHANISM

(71) Applicant: SCIFIT SYSTEMS, INC., Tulsa, OK (US)

(72) Inventor: Cole Dalton, Snohomish, WA (US)

(73) Assignee: SCIFIT SYSTEMS, INC., Tulsa, OK (US)

( * ) Notice: Subject to any disclaimer, the term of this patent is extended or adjusted under 35 U.S.C. 154(b) by 0 days.

(21) Appl. No.: 14/472,309

(22) Filed: Aug. 28, 2014

(65) Prior Publication Data

US 2015/0065305 A1 Mar. 5, 2015

Related U.S. Application Data

(60) Provisional application No. 61/871,272, filed on Aug. 28, 2013.

(51) Int. Cl.
*A63B 21/00* (2006.01)
*A63B 21/005* (2006.01)
(Continued)

(52) U.S. Cl.
CPC ..... *A63B 21/023* (2013.01); *A63B 21/055* (2013.01); *A63B 22/001* (2013.01);
(Continued)

(58) Field of Classification Search
CPC ..... A63B 21/00003; A63B 21/00007; A63B 21/00018; A63B 21/00021; A63B 21/00025; A63B 21/00029; A63B 21/00032; A63B 21/00036; A63B 21/00069; A63B 21/00072; A63B 21/00076; A63B 21/00094; A63B 21/00098; A63B 21/00109; A63B 21/0012; A63B 21/00123; A63B 21/00127; A63B 21/00178; A63B 21/00181; A63B 21/00185; A63B 21/00192; A63B 21/00196; A63B 21/005; A63B 21/0052;
(Continued)

(56) References Cited

U.S. PATENT DOCUMENTS

D321,229 S * 10/1991 Dalton ..... D21/670
5,129,872 A * 7/1992 Dalton ..... A63B 21/026 482/127

(Continued)

*Primary Examiner* — Loan H Thanh
*Assistant Examiner* — Gary D Urbiel Goldner
(74) *Attorney, Agent, or Firm* — Scott R. Zingerman

(57) ABSTRACT

A step exercise apparatus with a self-centering pedal system. The system comprising a frame and a seat supported from the frame. A first pedal assembly and a second pedal assembly are pivotally supported from the frame positioned so as to be manipulable by a user seated in the seat. A linkage is positioned in communication with the first pedal assembly and the second pedal assembly such that movement of either pedal assembly in a first direction causes movement of the other pedal assembly in a second direction opposite of the first direction. A brake is preferably employed for resisting motion of the first pedal assembly and the second pedal assembly in at least the first direction. A centering system positions the first and second pedal assemblies in a substantially central position when not being manipulated by the user.

11 Claims, 5 Drawing Sheets

(51) Int. Cl.

| | |
|---|---|
| ***A63B 21/02*** | (2006.01) |
| ***A63B 21/04*** | (2006.01) |
| ***A63B 21/055*** | (2006.01) |
| ***A63B 21/22*** | (2006.01) |
| ***A63B 22/00*** | (2006.01) |
| *A63B 71/06* | (2006.01) |

(52) U.S. Cl.
CPC ..... *A63B 22/0056* (2013.01); *A63B 21/0051* (2013.01); *A63B 21/0053* (2013.01); *A63B 21/0056* (2013.01); *A63B 21/0428* (2013.01); *A63B 21/154* (2013.01); *A63B 21/157* (2013.01); *A63B 21/225* (2013.01); *A63B 22/0046* (2013.01); *A63B 2022/0053* (2013.01); *A63B 2071/0658* (2013.01); *A63B 2208/0238* (2013.01); *A63B 2220/17* (2013.01); *A63B 2220/20* (2013.01); *A63B 2220/805* (2013.01); *A63B 2220/89* (2013.01); *A63B 2225/09* (2013.01); *A63B 2230/06* (2013.01); *A63B 2230/75* (2013.01)

(58) Field of Classification Search
CPC ..... A63B 21/0053; A63B 21/0056; A63B 21/0057; A63B 21/0058; A63B 21/012; A63B 21/0125; A63B 21/015; A63B 21/018; A63B 21/1465; A63B 21/1476; A63B 21/1488; A63B 21/1492; A63B 21/1496; A63B 21/15; A63B 21/151; A63B 21/154; A63B 21/155; A63B 21/156; A63B 21/157; A63B 21/158; A63B 21/159; A63B 21/22; A63B 21/225; A63B 21/227; A63B 2021/0059; A63B 2021/222; A63B 22/0015; A63B 22/0046; A63B 22/0048; A63B 22/0056; A63B 22/0058; A63B 22/0064; A63B 22/0069; A63B 22/04; A63B 22/08; A63B 2022/017; A63B 2022/002; A63B 2022/0051; A63B 2022/0053; A63B 2022/0066; A63B 2022/0074; A63B 23/0216; A63B 23/035; A63B 23/03508; A63B 23/03516; A63B 23/03533; A63B 23/04; A63B 23/0405; A63B 23/0429; A63B 23/0482; A63B 23/0488; A63B 23/0494; A63B 2023/0441; A63B 2023/0447; A63B 2023/0452; A63B 69/0048; A63B 69/0057; A63B 71/0009; A63B 71/0054; A63B 2208/0228; A63B 2208/0233; A63B 2208/0238
See application file for complete search history.

(56) References Cited

U.S. PATENT DOCUMENTS 5,318,490 A * 6/1994 Henderson ..... A63B 21/026 482/125
5,320,588 A * 6/1994 Wanzer ..... A63B 22/0056 482/53
5,322,491 A * 6/1994 Wanzer ..... A63B 22/0056 482/52
5,356,356 A * 10/1994 Hildebrandt ..... A63B 21/157 482/57
5,387,169 A * 2/1995 Wang ..... A63B 21/154 482/148
5,478,296 A * 12/1995 Lee ..... A63B 22/001 482/131
5,611,758 A * 3/1997 Rodgers, Jr. ..... A63B 22/001 482/51
5,749,807 A * 5/1998 Webb ..... A63B 21/157 482/52
6,042,518 A * 3/2000 Hildebrandt ..... A63B 21/157 482/57
6,283,895 B1 * 9/2001 Stearns ..... A63B 22/0015 482/51
6,334,624 B1 * 1/2002 Giglio ..... A63B 21/0087 280/304.1
6,666,799 B2 * 12/2003 Hildebrandt ..... A63B 21/157 482/57
7,713,176 B1 * 5/2010 Farney ..... A63B 21/154 482/52
7,996,080 B1 * 8/2011 Hartman ..... A63B 21/00181 607/2
2004/0072654 A1 * 4/2004 Chen ..... A63B 22/0056 482/52
2004/0259692 A1 * 12/2004 Martin ..... A63B 22/0007 482/52
2006/0276311 A1 * 12/2006 Martin ..... A63B 23/03575 482/92
2007/0037677 A1 * 2/2007 Splane, Jr. ..... A63B 21/1492 482/121
2007/0161463 A1 * 7/2007 Eschenbach ..... A63B 22/001 482/52
2009/0124467 A1 * 5/2009 Hildebrandt ..... A63B 21/154 482/62
2009/0239714 A1 * 9/2009 Sellers ..... A63B 22/001 482/52
2010/0320716 A1 * 12/2010 Sung ..... B62M 1/28 280/210
2011/0218078 A1 * 9/2011 Coates ..... A63B 22/04 482/52
2012/0277066 A1 * 11/2012 Hsu ..... A63B 22/001 482/57
2012/0316035 A1 * 12/2012 Andreasen ..... A61H 1/0214 482/7
2013/0045839 A1 * 2/2013 Hsu ..... A63B 22/04 482/52
2013/0137550 A1 * 5/2013 Skinner ..... A63B 24/0087 482/5
2013/0331243 A1 * 12/2013 Walkama ..... A63B 26/00 482/130
2014/0191552 A1 * 7/2014 Weber ..... A63B 22/0046 297/344.21
2014/0209399 A1 * 7/2014 Mireshghi ..... B60L 11/007 180/65.31
2014/0274621 A1 * 9/2014 Chen ..... A63B 21/0421 482/142

* cited by examiner

RECUMBENT STEP EXERCISER WITH SELF-CENTERING MECHANISM

CROSS REFERENCE TO RELATED APPLICATION

This application claims the benefit of U.S. Provisional Application No. 61/871,272 filed Aug. 28, 2013, herein incorporated by reference in its entirety for all purposes.

FIELD OF THE INVENTION

The present invention relates generally to exercise equipment. More specifically, the present invention relates to the field of stair climbing, or stepper, exercise machines.

SUMMARY OF THE INVENTION

A step exercise apparatus with a self-centering pedal system. The system comprising a frame and a seat supported from the frame. A first pedal assembly is pivotally supported from the frame positioned so as to be manipulable by a user seated in the seat and a second pedal assembly pivotally supported from the frame positioned so as to be manipulable by the user seated in the seat. A linkage is positioned in communication with the first pedal assembly and the second pedal assembly such that movement of either pedal assembly in a first direction causes movement of the other pedal assembly in a second direction opposite of the first direction. A brake is preferably employed for resisting motion of the first pedal assembly and the second pedal assembly in at least the first direction. A centering system positions the first and second pedal assemblies in a substantially central position when not being manipulated by the user.

The step exercise apparatus of the present disclosure may further include a seat adjustment mechanism such that said seat may be selectively moved forward or rearward to accommodate users of varying leg length. In addition, in a preferred embodiment, the seat may be positioned relative to the first and second pedal assemblies so as to provide step-through space to facilitate access by the user.

In the step exercise apparatus of the present disclosure the brake may also act as a generator.

The centering system of the present disclosure includes a first spring in communication with the first pedal assembly and a second spring in communication with the second pedal assembly. Forces applied by the first and second springs are equal when the first and second pedal assemblies are substantially centered.

BACKGROUND OF THE INVENTION

Many different designs of equipment exist for the purpose of physical exercise and physical therapy. One such type, stair climbing machines, or steppers, simulate climbing stairs or steps. With such machine designs known in the industry, the user typically places his or her feet on a pair of pedals and begins to alternately raise his or her legs as if he or she were climbing a flight of stairs. The pedals respond by raising and applying a load resistance which the user must overcome to lower the pedal. The amount of resistance is determined by the weight and/or fitness level of the user. Steppers are known to provide a superior low impact workout for therapy, rehabilitation or cardiovascular conditioning for the amount of time spent by the user on the machine.

One problem with stair climbing machines known in the art is that such steppers require the user to be standing in order to operate the machines. This limitation restricts usage to those who are physically capable of standing during exercise and are thus less than optimal for physical therapy and rehabilitation use. A need, therefore exists for a stepper type exercise device which can be operated in a seated position by those who are unable to stand.

Alternatively, people who are less fit have been known to find stair climbing machines to be too difficult to operate for extended periods of time. In such cases, workouts tend to be shortened, thereby also reducing the aerobic benefit of the workout. A need, therefore, also exists for a stepper type exercise device which allows users who are less physically fit to achieve a sustained cardiovascular workout.

A related limitation is that since the user is in a standing position, the user can effectively use less than his or her body weight alone to overcome the resistance required to raise the pedal. In this manner, the aerobic benefit of the workout is reduced. In addition, it has been known in the art that persons of low body weight sometimes cannot drive known stepper exercise devices because they can exert no more down force than their body weight. As a result, a need exists for a stepper type exercise device which is not responsive to the weight of the user.

SUMMARY OF THE INVENTION

The embodiments herein and the various features and advantageous details thereof are explained more fully with reference to the non-limiting embodiments that are illustrated in the accompanying drawings and detailed in the following description. Descriptions of well-known components and processes and manufacturing techniques are omitted so as to not unnecessarily obscure the embodiments herein. The examples used herein are intended merely to facilitate an understanding of ways in which the invention herein may be practiced and to further enable those of skill in the art to practice the embodiments herein. Accordingly, the examples should not be construed as limiting the scope of the claimed invention.

DETAILED DESCRIPTION OF THE PREFERRED EMBODIMENTS

Before describing the preferred embodiments of the present invention in detail, it is important to understand that the invention is not limited in its application to the details of the construction illustrated and the steps described herein. The invention is capable of other embodiments and of being practiced or carried out in a variety of ways. It is to be understood that the phraseology and terminology employed herein is for the purpose of description and not limitation.

Figure 1:
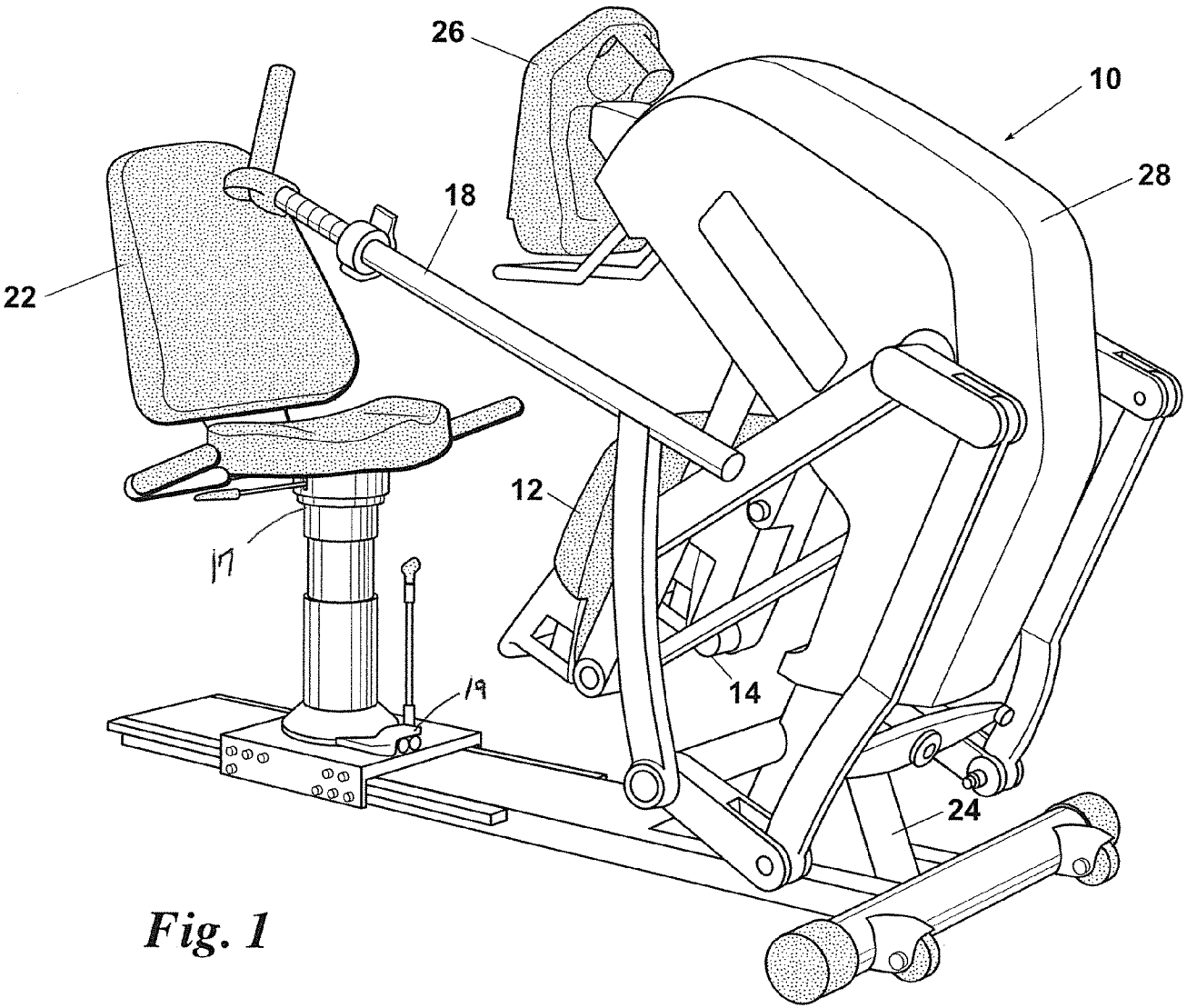
FIG. 1 depicts the inventive step exerciser in its general environment.
Figure 2:
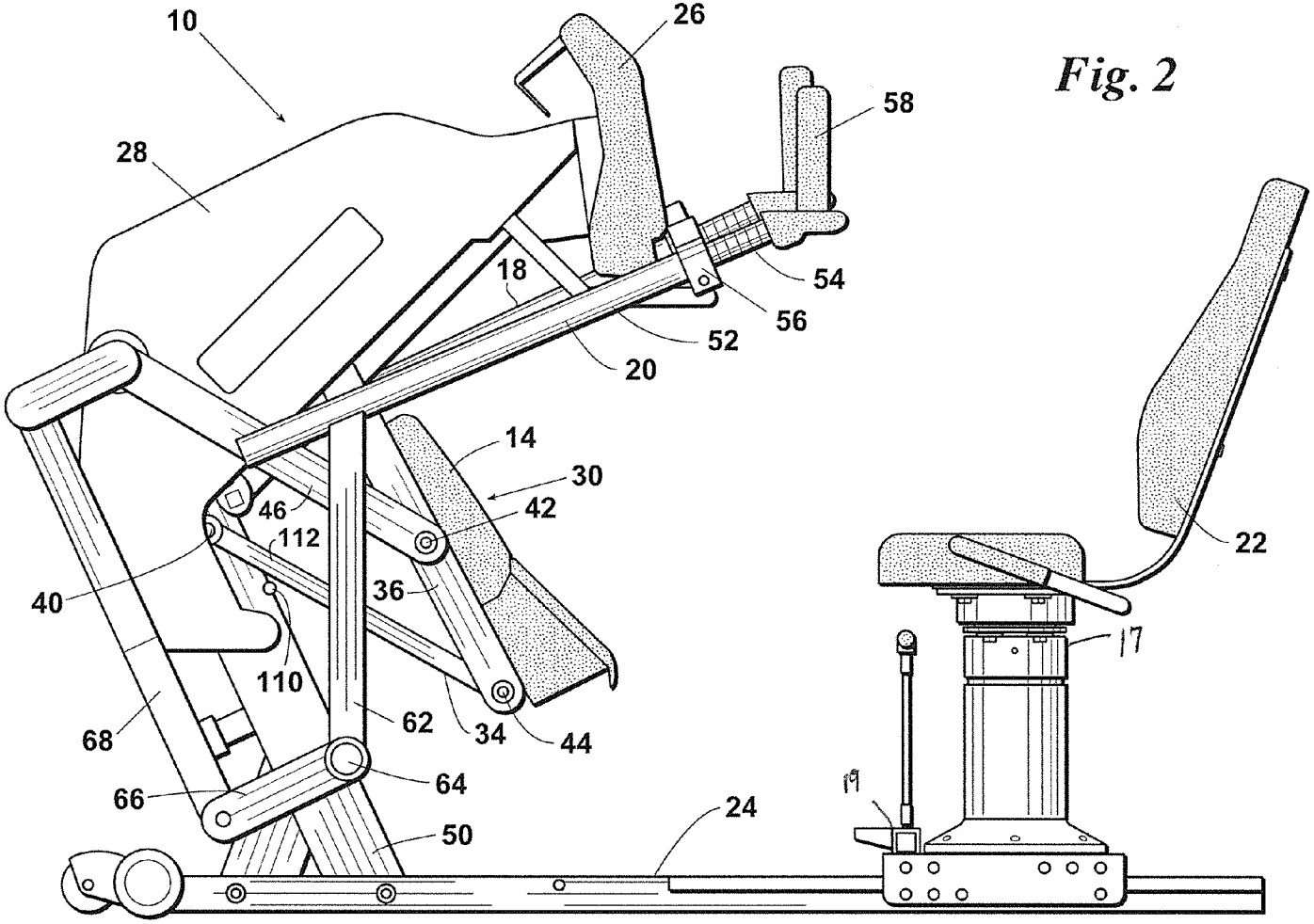
FIG. 2 provides a left side view of one preferred embodiment of the step exerciser of FIG. 1.

Referring now to the drawings, wherein like reference numerals indicated the same parts throughout the several views, the step exercise apparatus 10 of the present disclosure is shown in its general environment in FIGS. 1 and 2.

In one preferred embodiment, exerciser 10 is a recumbent step exerciser comprising: a pair of pedal assemblies 12 and 14 which are alternatingly pushed down and away from the user 16; a pair of arm mechanisms 18 and 20 which are pulled toward the user 16; a seat 22 to support the user 16 during a workout; a frame 24 which generally supports exerciser 10; and display unit or console 26 which allows the user 16 to select a particular workout and to provide various information to the user, such as watts METS, heart rate, steps per minute, calories, steps taken, and, as will be described more fully below, stride length. Cover 28 protects internal components of exerciser 10 from dust, sweat, and other contaminants, as well as protecting people from internal moving parts and providing an aesthetically pleasing appearance. Many features described above are present in existing step exercisers such as the recumbent step exerciser described in U.S. Pat. No. 7,713,176, which is incorporated by reference as if full set forth herein.

It should be noted that as described herein, terms of position, such as forward, rearward, left, right, etc., indicate position from the perspective of a user of the machine. These descriptions are for the purpose of clarity, explanation and exemplification and it is understood that they are in no way limiting.

In one preferred embodiment seat 22 may be adjusted forward or rearward by seat adjustment assembly 19 or vertically by mechanism 17.

Figure 3:
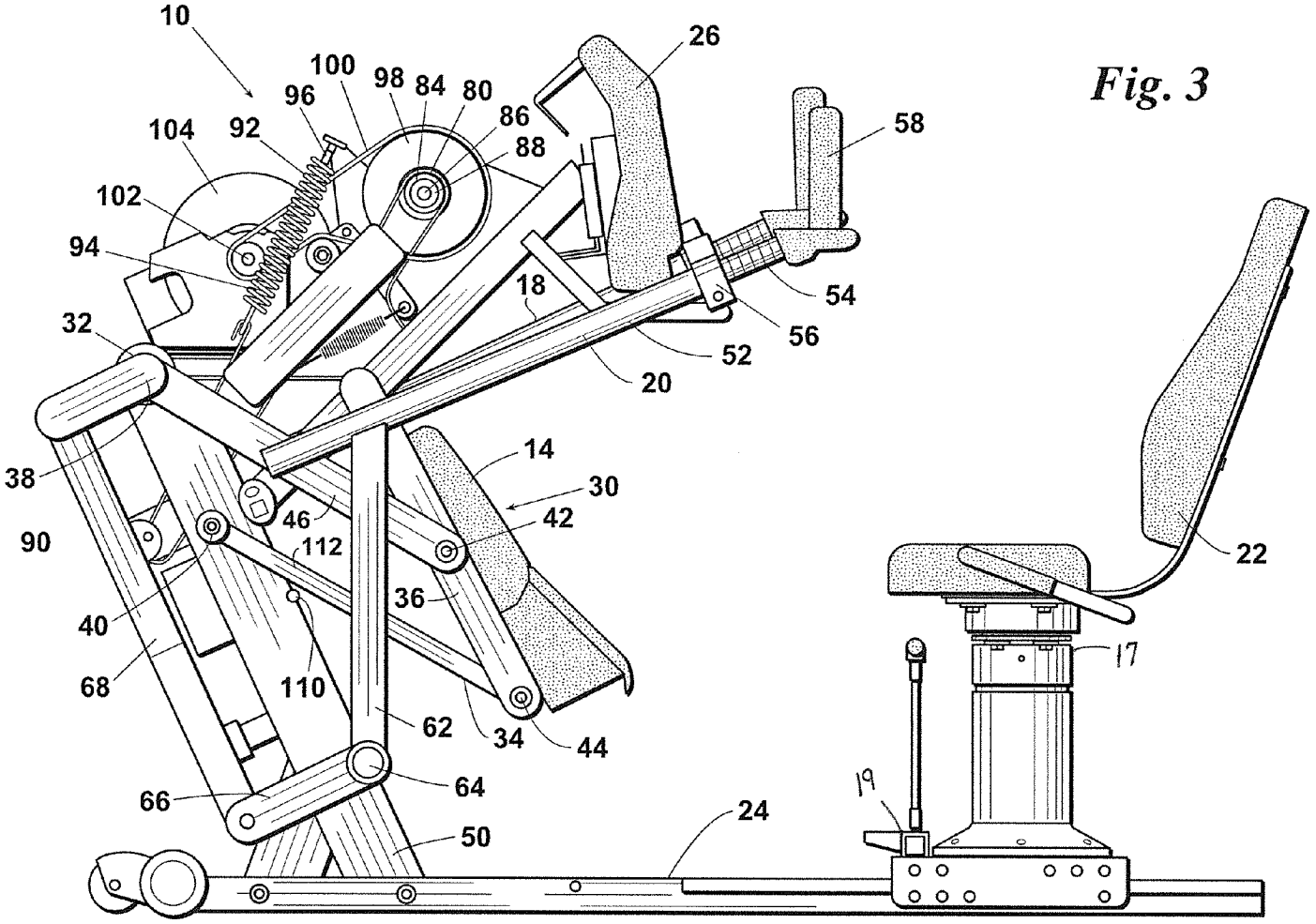
FIG. 3 provides a left side view of the embodiment of FIG. 2 with exterior panels removed.

While specific details of the operation of many of the features of exerciser 10 are not necessary to understand the present invention, for the sake of clarity and for the benefit of those not familiar with step exercisers, in general, and by way of example and not limitation, a brief description of the overall operation of exerciser 10 is provided. Pedal assemblies 12 and 14 are connected to frame 24 through a four-bar linkage assembly which controls articulation of the associated pedal. As best seen in FIG. 3, four-bar linkage assembly 30 comprises: crank 32; lower link 34; pedal support 36 connected to crank 32 and link 34 at pivots 42 and 44, respectively; and crank 32 and lower link 34 connect to frame 24 at pivots 38 and 40, respectively. Articulation of pedal 36 is achieved by the difference between the radius of arc followed by pivot 42 and the radius of arc followed by pivot 44. If the upper bar 46 is the same length as lower link 34, and the distance between pivots 38 and 40 is equal to the distance between pivots 42 and 44, pedal support 36 will remain parallel to frame support 50 throughout the pedal's range of motion.

Figure 4:
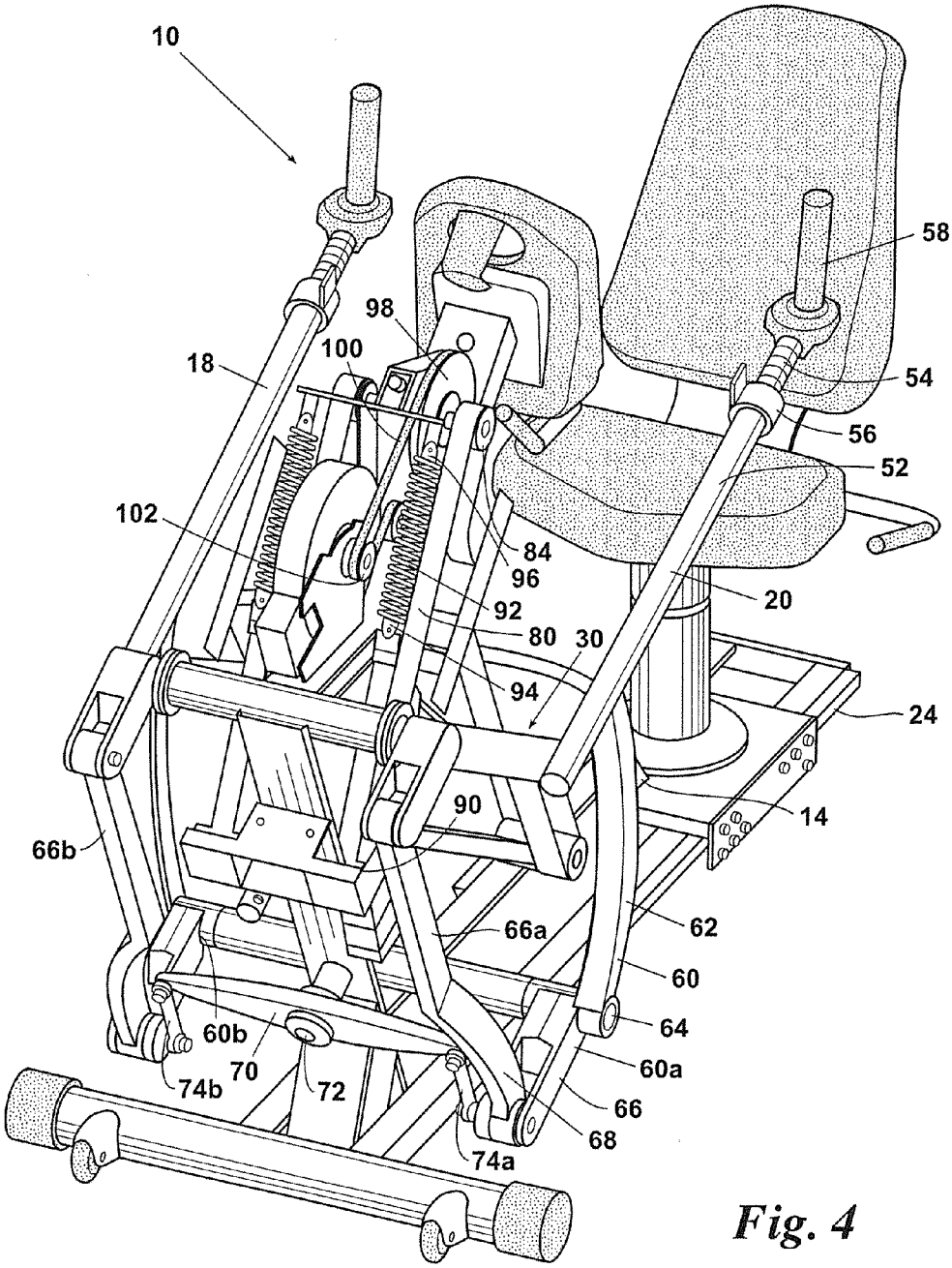
FIG. 4 provides an isometric view of the embodiment of FIG. 2 with exterior panels removed.

With further reference to FIG. 4, the movement of arm mechanisms 18 and 20 is coordinated with the movement of pedal assemblies 12 and 14, respectively. Arm mechanisms 18 and 20 include: outer bar 52; inner bar 54 telescopically received in outer bar 52; latch 56 to lock bar 54 relative to bar 52; grip assembly 58 located at the distal end of bar 54; bell crank 60 attached to frame 24 at pivot 64, having a first arm 62 attached proximate the forward end of bar 18 or 20 and a second arm pivotally attached to link 68. Thus, as best seen in FIG. 3, when the user pushes pedal assembly 30, crank 32 will rotate about pivot 38, lifting link 68, which in turn will lift arm 66 of bell crank 60, causing arm 62 to push bar 20 rearward towards the user. As pedal assembly 30 moves towards the user, the motion of bar 20 is reversed, away from the user.

With reference to FIG. 4, once a pedal 12 or 14 is pushed forward by the user, it is returned to its rearward position by movement of the opposite pedal. This is commonly referred to as a dependent system. The dependent system of exerciser 10 includes: pivot bar 70 pivotally attached to frame 24 at pivot 72; linkage 74*a* pivotally attached between left crank 60*a* and the left end of pivot bar 70; and linkage 74*b* pivotally attached between right crank 60*b* and the right end of pivot bar 70. Thus, upward movement of arm 66*a*, in response to pushing pedal assembly 14, will cause downward movement of arm 66*b* resulting in returning pedal 12 to its upward and rearward position, closer to the user. Pressing pedal 12 will similarly cause pedal 14 to return to its upward and rearward position.

In contrast, an independent system typically uses a spring associated with each pedal to return the pedal to its rearward position. As will be readily apparent to one of ordinary skill in the art, the present invention works equally well with either a dependent or an independent pedal system.

To provide resistance to movement of the pedals, step exerciser 10 includes a braking system driven by movement of the pedals and/or arms. Explanation will be made with regard to the left side of exerciser 10 with the understanding that the right side works in an identical manner. To harness energy from pedal movement, a belt 80 is attached to pedal assembly 30 at end 82 (FIG. 3). As best seen in FIG. 3, belt 80 then passes over driven sprocket 84 which is rotationally coupled to shaft 86 via overrun clutch 88 such that clutch 88 engages shaft 86 as the pedal is pushed to turn shaft 86 in a clockwise direction as viewed in FIG. 4. Belt 80 then passes over idler pulley 90 and attaches to end 94 of spring 92. The opposite end 96 of spring 92 attaches to frame 24. As will be apparent to one of ordinary skill in the art, as a user pushes pedal 14, shaft 86 will be driven in a clockwise direction, as pedal 14 is pushed back to its upward position by the opposite pedal, spring 92 will pull the take up the slack in belt 80 and overrun clutch 86 will disengage shaft 84 allowing driven pulley 82 to rotate freely in a counterclockwise direction. When pedal 12 is pushed, its associated driven pulley will likewise couple torque into shaft 86 in the same direction thus producing continuous rotation in shaft 84 as the user manipulates the pedals.

One feature of the present invention is a centering system preferably spring 92, and its counterpart on the right (or opposite) side, will tend to move the pedals 12 and 14 to a point where both springs are equally extended when the machine 10 is idle, centering the pedals. This serves a number of purposes, for example, with the arms and pedals in a centered position, access to the seat is not blocked when a user approaches the machine. Additionally, it is easier to properly adjust the position of seat 22 (FIG. 2) when the pedals and arms are centered so that the user doesn't inadvertently adjust the seat where she or the is bumping into the limits of the movement at the top or bottom. Finally, the user will generally have his or her range of motion centered about the middle of the pedal range of motion.

Shaft 84 then drives speed increasing pulley 98, which in turn drives belt 100, which further drives the input 102 brake 104. In one preferred embodiment, brake 104 offers two braking modes, an eddy current mode for lower speeds and a generator mode for higher speeds. However, brake 104 is not so limited and a variety of options are available. By way of example and not limitation, brake 104 (or means for braking) could be an alternator, a generator, an eddy current brake, a magnetic particle brake, a friction brake, or the like. As will be apparent to one of ordinary skill in the art, the energy expended by the user will ultimately be dissipated into the environment as heat, a brake, of any style, simply provides a method for doing so. If a brake is chosen which produces electricity, a load resistor is wired across the output of the generator to produce heat.

Figure 5:
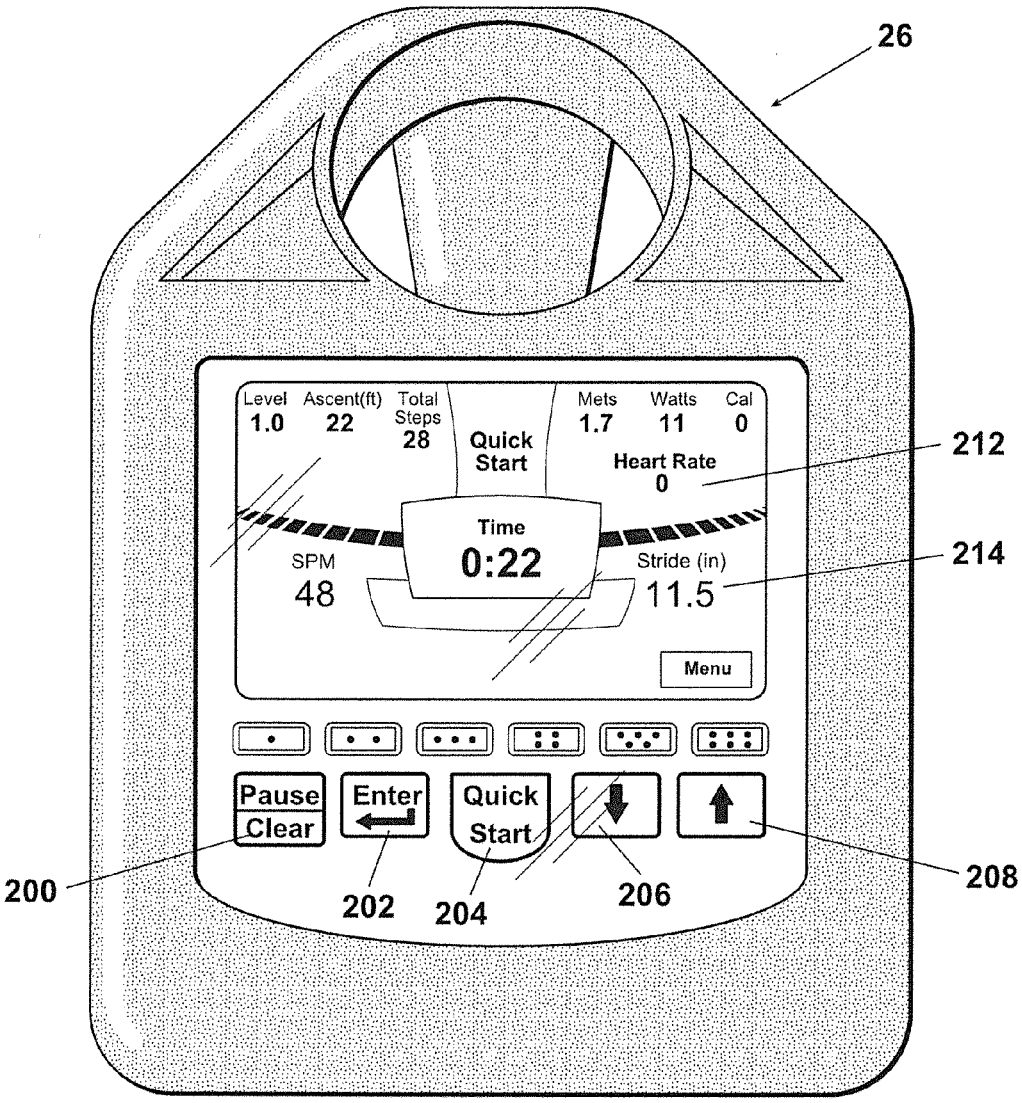
FIG. 5 provides one preferred embodiment for an electronic console as used on the step exerciser of FIG. 1.

Turning next to FIG. 5, console 26 provides the user interface for recumbent step exerciser 10. Console 26 provides a plurality of buttons 200-208 to allow the user to adjust the resistance, enter data, and the like. Console 26 further includes LCD screen 212 to prompt the user for data, as well as provide work out details, such as the speed the user is climbing, steps climbed, calories burned, watts being produced, METs (metabolic rate), elapsed time, etc. In one preferred embodiment, screen 212 is a touch screen so that the user may be provided with various ways to input various information before, during, and after the workout, without cluttering console 26 with buttons which might only be active a few seconds during a workout session. Of particular interest, is the ability of console 26 to display stride length 214.

Returning to FIG. 3, to count steps taken, step exerciser 10 includes a sensor 110 on frame 24. Preferably, sensor 110 is a Hall effect sensor, reed switch, or other suitable sensor sensitive to magnetic fields. A magnet is then placed proximate position 112 on arm 34 such that as pedal 14 is pressed forward, the magnet on arm 34 will pass the sensor. The sensor is in communication with console 26 allowing it to count steps taken on the machine. It should be noted that, since the pedals are biased towards their mid-position when the machine is idle, sensor 110 can be placed where only slight movement from the idles position will count a step. Thus, regardless of how small of movements a user makes, steps will still be counted. It should also be noted that there are many locations on frame 24 where the sensor could be placed and where a corresponding magnet could be placed. For example, wherever arms 34 or 46 intersect a portion of frame 24, where arm 38 intersects frame 24, where pedal assembly 30 intersects frame 24, where are 68 passes near frame 24, along arm 66, etc. The only consideration being that either the sensor or magnet moves in response to pedal movement and passes near the corresponding element. Finally, while the preferred embodiment uses a magnetic sensor, the invention is not so limited, optical sensors could be used, mechanical switches, or any other known proximity sensor would be suitable.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. A step exercise apparatus comprising:

a frame including a substantially horizontal section and a frame support section supported by and extending upwardly therefrom;

a seat supported and extending upwardly from said substantially horizontal section of said frame;

said frame support section being spaced from said seat, a first pedal assembly pivotally supported from said frame positioned so as to be manipulable by a user seated in said seat, said first pedal assembly movable between a first position and a second position in a reciprocating manner;

a second pedal assembly pivotally supported from said frame positioned so as to be manipulable by the user seated in said seat, said second pedal assembly movable between a first position and a second position in a reciprocating manner;

a linkage in communication with said first pedal assembly and said second pedal assembly such that movement of either pedal assembly in a first direction causes movement of the other pedal assembly in a second direction opposite of said first direction;

a brake for resisting motion of said first pedal assembly and said second pedal assembly in at least said first direction;

a centering system for positioning said first and second pedal assemblies in a substantially central position when not being manipulated by the user;

said first pedal assembly, said second pedal assembly, said linkage, said brake, and said centering system being supported from said frame support section and spaced from said seat such that said brake is positioned above a portion of said seat.

2. The step exercise apparatus of claim 1 further comprising a seat adjustment mechanism such that said seat may be selectively moved forward or rearward to accommodate users of varying leg length.

3. The step exercise apparatus of claim 2 wherein said seat is positioned relative to said first and second pedal assemblies so as to provide step-through space therebetween.

4. The step exercise apparatus of claim 1 wherein said brake is a generator.

5. The step exercise apparatus of claim 1 wherein said centering system comprises a first spring in communication with said first pedal assembly and a second spring in communication with said second pedal assembly wherein forces applied by said first and second springs are equal when said first and second pedal assemblies are substantially centered.

6. The step exercise apparatus of claim 1 further comprising a seat adjustment mechanism such that said seat may be raised or lowered.

7. A step exercise apparatus to be manipulated by a user, the step exercise apparatus comprising:

a frame;

a seat supported from said frame;

a first pedal assembly including a first pedal;

said first pedal assembly pivotally supported from said frame by a four bar linkage and positioned so as to be manipulable by the user seated in said seat, said first pedal assembly movable between a first position and a second position in a reciprocating manner;

a second pedal assembly including a second pedal;

said second pedal assembly pivotally supported from said frame by a four bar linkage, different from said four bar linkage supporting said first pedal assembly, positioned so as to be manipulable by the user seated in said seat, said second pedal assembly movable between a first position and a second position in a reciprocating manner;

said first pedal and said second pedal each being substantially supported from a position on said frame above said first pedal and said second pedal;

a linkage in communication with said first pedal assembly and said second pedal assembly such that movement of either pedal assembly in a first direction causes movement of the other pedal assembly in a second direction opposite of said first direction;

a brake for resisting motion of said first pedal assembly and said second pedal assembly in at least said first direction;

a centering system including a first spring in communication with said first pedal assembly and a second spring in communication with said second pedal assembly wherein forces applied by said first and second springs are equal when said first and second pedal assemblies are substantially centered.

8. The step exercise apparatus of claim 7 further comprising a seat adjustment mechanism such that said seat may be selectively moved forward or rearward to accommodate users of varying leg length.

9. The step exercise apparatus of claim 7 wherein said seat is positioned relative to said first and second pedal assemblies so as to provide step-through space therebetween.

10. The step exercise apparatus of claim 7 further comprising a seat adjustment mechanism such that said seat may be raised or lowered.

11. The step exercise apparatus of claim 7 wherein said brake is a generator.

* * * * *